US005308075A

United States Patent [19]

Theriault

[11] Patent Number: 5,308,075

[45] Date of Patent: May 3, 1994

[54] CONFIGURABLE GOLF PRACTICE MAT

[76] Inventor: Joseph H. Theriault, 424 Emerson Dr., Raleigh, N.C. 27609

[21] Appl. No.: 20,757

[22] Filed: Feb. 22, 1993

[51] Int. Cl.[5] ..... A63B 69/36

[52] U.S. Cl. ..... 273/195 A; 273/195 B; 29/773; 29/897

[58] Field of Search ..... 273/195 R, 195 A, 195 B, 273/176 H; 29/773, 897

[56] References Cited

U.S. PATENT DOCUMENTS 3,534,961 10/1970 Tiley ..... 273/176 H X

FOREIGN PATENT DOCUMENTS 2072022 9/1981 United Kingdom ..... 273/176 H

*Primary Examiner*—George J. Marlo

*Attorney, Agent, or Firm*—Rhodes, Coats & Bennett

[57] ABSTRACT

A golf practice aid is configurable by the user to simulate the contour of sloping or irregular terrain. The golf practice aid includes a flexible bag filled with a granular media such as plastic pellets. A flexible mat is adhered to an outer surface of the flexible bag-like enclosure. The flexible mat has a tufted surface which simulates natural turf and defines a practice area for practicing one's golf swing. In use, the bag is shaped to the desired configuration by manually pressing on the outer surface of the bag to shift the granular media. Once the desired configuration is obtained, the air is extracted from the bag. The bag collapses as the air is extracted to retain the pellets in the desired shape and to form a relatively rigid surface to support underlying the pressure mat upon which the user can stand.

7 Claims, 2 Drawing Sheets

CONFIGURABLE GOLF PRACTICE MAT

FIELD OF THE INVENTION

The present invention relates generally to golf training and practice devices and more particularly to practice mats for simulating natural turfs.

BACKGROUND OF THE INVENTION

Golf is a game which requires a precise body alignment and a precise swing in order to obtain any degree of success. Even slight improper motion can greatly hinder a player's performance. Repetitive practice is therefore essential in developing one's golf game.

Golf driving ranges have been set up to allow golfers to develop and maintain the skills required for the game. Most golf practice ranges include a level area for teeing off. Some practice ranges include practice mats which simulate artificial turfs. In most instances, the teeing off area in the practice range is flat.

Ideally, the golfer should practice his swing under conditions which approximate those encountered on the course where varying playing conditions may be encountered. For example, the golf ball may come to rest on an upward slope, or a downward slope, or a side slope. Further, the contour of the golf course is quite irregular and may require that the golfer stand at an angle which differs from the angle on which the ball lies.

While conventional driving ranges are quite popular, they do not simulate the actual conditions that the player may encounter on the golf course. Most driving ranges provide no area in which a golfer may practice his or her swing on an uneven slope. Further, practice mats which are used at most practice ranges do not have the same "feel" as natural turf.

In the past, it is known to mount a golf practice mat on a platform which can be titled at an angle relative to the ground. Examples of tilting platforms are shown in the patents to Ahn, U.S. Pat. No. 5,046,741; Seilburg, et al., U.S. Pat. No. 4,613,133; Hughes, U.S. Pat. No. 4,331,332; and Bay et al., U.S. Pat. No. 4,279,420. Such devices have numerous drawbacks. First, many tilting platforms require complicated mechanical devices for raising and lowering the platform. Furthermore, the surface of the platform, though tilted, is planar and does not accurately simulate the contour of natural turf.

Accordingly, there is a need for a golf practice device which simulates the sloping conditions which may be encountered on an actual course, and also simulates the feel of natural turf.

SUMMARY AND OBJECTS OF THE INVENTION

The present invention addresses the needs of the prior art by providing a golf practice mat which can be configured by the user to simulate virtually any sloping condition or irregular contour which might be encountered on an actual golf course. The golf practice aid comprises a flexible mat attached to a pliable bag filled with small plastic pellets. The bag resembles a bean bag and can be shaped by manually pressing the bag to shift the beads inside the bag. After achieving the desired shape, a vacuum pump is connected to a valve in the bag to extract the air from the bag. As air is extracted from the bag, the bag collapses around the pellets to retain the pellets in the desired shape. Upon collapsing, the bag becomes rigid enough to support the user's weight while the user practices his or her golf swing.

Based on the foregoing, it is apparent that the primary purpose of the present invention is to provide a golf practice mat which simulates sloping or irregular terrain so that the user can gain practice under conditions similar to those likely to be encountered on the golf course.

Another object of the present invention is to provide a golf practice aid for simulating sloping and irregular terrain which has no moving parts and can be readily transported by the golfer.

Still another object of the present invention is to provide a golf practice aid which simulates the feel of natural turf.

Other objects and advantages of the present invention will become apparent and obvious from a study of the following description and the accompanying drawings which are merely illustrative of such invention.

DETAILED DESCRIPTION OF THE INVENTION

Figure 1:
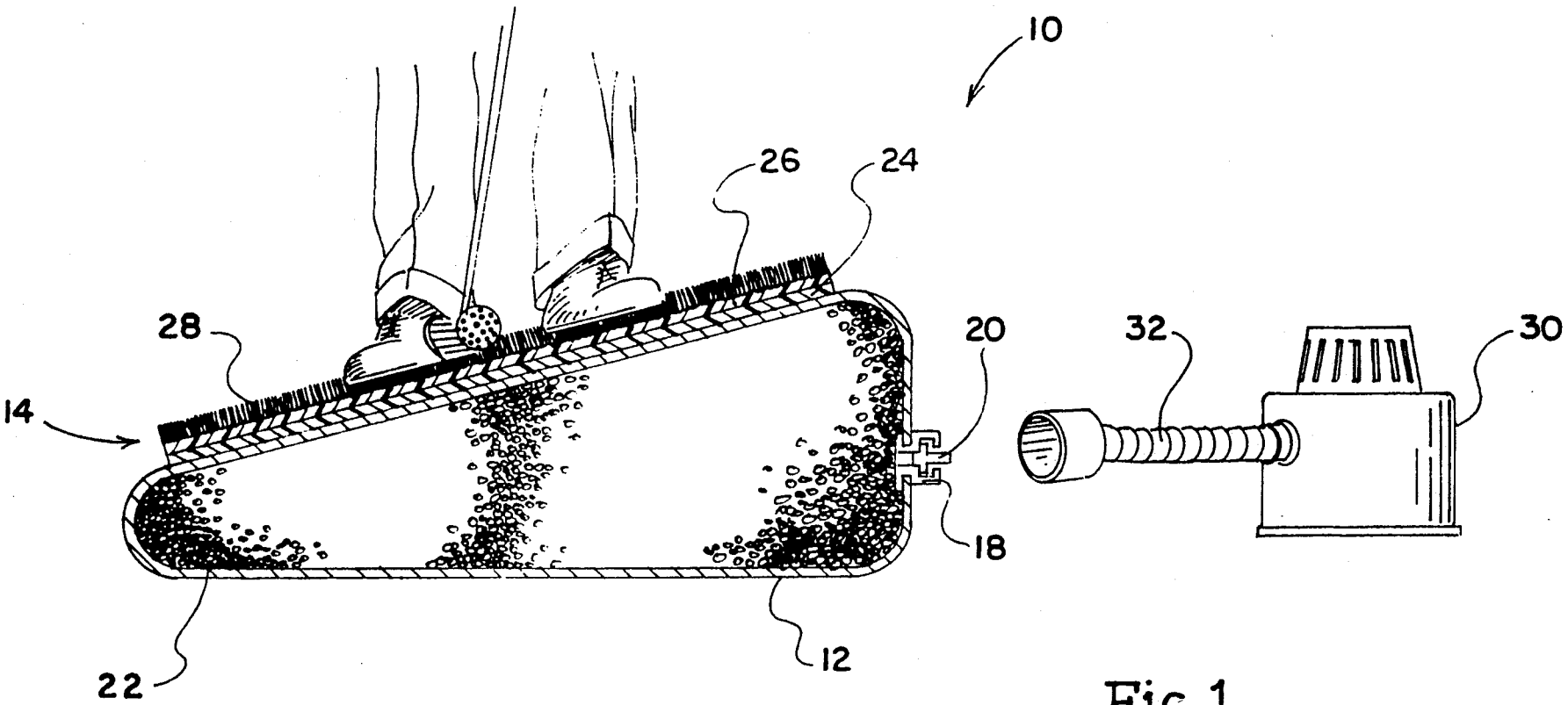
FIG. 1 is a section view of the golf practice mat of the present invention.

Referring now to the drawings, the golf practice mat of the present invention is shown therein and indicated generally by the numeral 10. The golf practice mat 10 consists generally of a pliable bag 12 filled with small plastic beads and a flexible practice mat 14 adhered to the outer surface of the bag 12.

The bag 12 consists is made from a pliable, waterproof sheet material such as vinyl or olefin. A one-way check valve 18 with a manual release 20 extends through the bag 12. The check valve 18 prevents air from entering the bag 12 while allowing air to be extracted. The manual release 20 opens the check valve 18 allowing the passage of air in either direction.

The bag 12 is substantially filled with small pellets 22 made from a light weight, plastic material such as polystyrene or polyurethane. The pellets 22 should be relatively hard so as not to compress easily. The pellets 22 should substantially fill the bag 12. Preferably, the pellets 22 should consume approximately 75% of the bag's volume, and more preferably 90%.

A practice mat 14 is bonded by an adhesive to the outer surface of the bag 12. The practice mat 14 consists of a flexible base member 24 made from a resilient plastic material such as polycarbonate sold under the trademark LEXAN ®. Natural or synthetic rubber may also be used. The material is self supporting, but will deform if a load is placed thereon. The base member 24 is generally planar, and has a generally rectangular shape. Although the invention will be described with the generally rectangular base member 24, it is to be understood that other shapes may be utilized.

An artificial turf surface 26 is bonded by adhesive to the base member 24 and defines a golf ball hitting surface. The artificial turf surface includes tufts 28 which simulate natural grass. The artificial turf is preferably coextensive with the base member 24. If desired, a layer of cushioning material, such as foam rubber, can be interposed between the base member 24 and artificial turf 26, although such is not required.

A hand operated vacuum pump 30 will typically be provided with the golf practice mat 10. The vacuum pump 30 can be connected by a line 32 to the check valve 18 in the bag 12. The purpose of the hand pump 30 is to extract air from the bag 12 to make the bag rigid as will be hereinafter described.

To use the golf practice aid 10 of the present invention, the manual release 20 of the check valve 18 is pressed to allow air to enter the bag 12. The bag 12 16 can then be shaped in a manner similar to a bean bag by manually pressing the outer surface of the bag-like enclosure 16. By applying pressure to the outer surface of the bag 12, the pellets 22 contained therein can be moved until the desired shape or configuration is attained.

After achieving the desired shape, the hand pump 30 is connected to the check valve 18. Using the hand pump 30, air is extracted from the bag 12. As the air is extracted, the bag 12 collapses to conform to the shape of the pellets 22. Once the air is extracted, the bag 12 becomes rigid and can support the weight of a user.

The user places the golf ball on the tufted surface 28 of the mat 14 and assumes a normal golf stance on the mat 14. The user can then practice his or her golf swing in the usual manner. The weight of the user is supported entirely by the bag 12.

Figure 2:
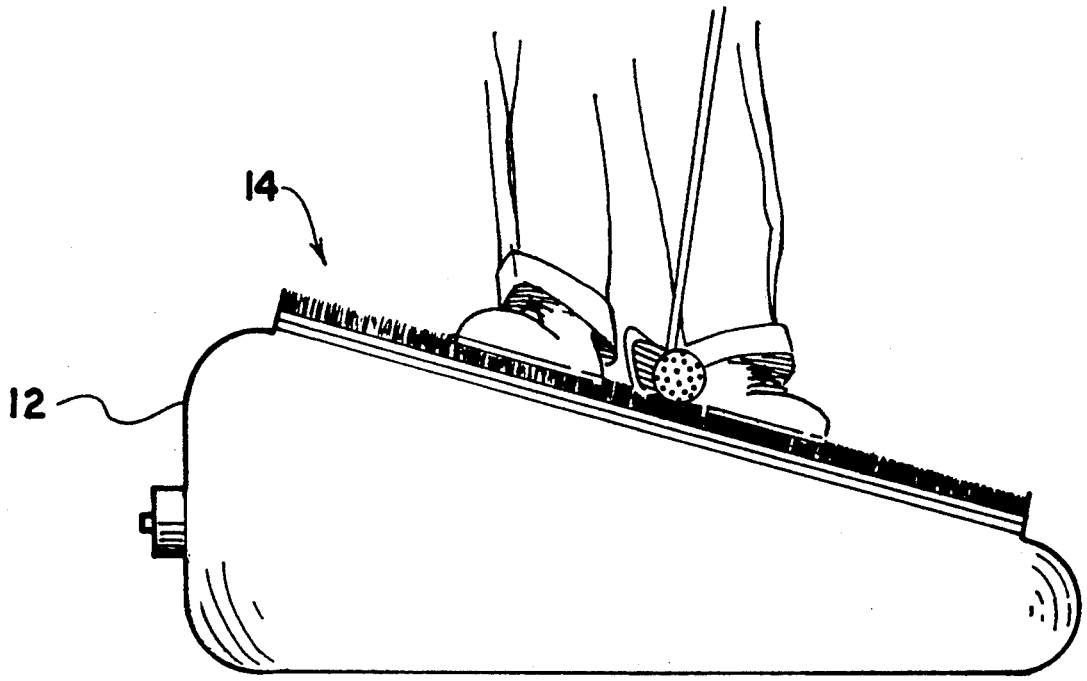
FIG. 2 is a schematic diagram illustrating the golf practice mat in a down-hill sloping configuration.
Figure 3:
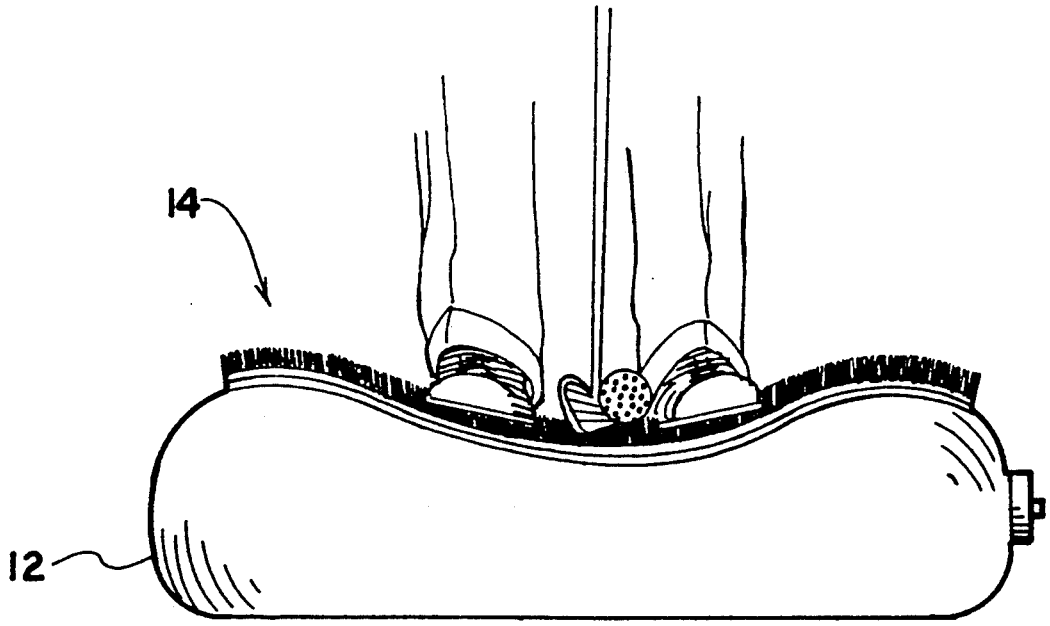
FIG. 3 is a schematic diagram illustrating the golf practice mat in a dipping configuration.

After practicing in one configuration, the user can then press the release 20 on the one-way valve 18 and reconfigure the bag as desired to simulate other conditions. FIGS. 2 and 3 show in schematic form several configurations which could be simulated. FIG. 2 shows the golf practice mat 10 of the present invention configured to simulate a down-hill sloping condition. FIG. 3 shows the golf practice mat 10 configured to simulate an irregular terrain having a dip. Of course, the number of possible configurations is virtually endless.

Based on the foregoing, it is apparent that the golf practice aid 10 of the present invention is useful for practicing one's golf swing on sloped or irregular terrains which are likely to be encountered on a golf course. Further, the golf practice aid 10 of the present invention simulates the feel of natural turf due to the flexibility of a bag 12 and the shifting of the pellets 22 upon impact of the club head with the golf mat 14. The golf practice aid 10 is light weight and can be easily transported by the user from one location to another.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. A golf practice aid comprising:

(a) a pliable bag;

(b) a granular media filling the bag;

(c) a flexible practice mat secured to the outside of the bag and defining a practice area; and (d) a valve in said bag for admitting air into and extracting air from said bag; and (e) a vacuum device connectable to said valve for extracting air from said bag so that the bag conforms to the shape of the granular media contained therein and provides a relatively rigid support underlying said flexible mat.

2. The golf practice aid of claim 1 wherein said flexible mat comprises a base member made from a resilient material that is self supporting but will deform under a load, and an artificial turf bonded to the base member.

3. The golf practice aid of claim 1 wherein said valve means comprises a one-way check valve to prevent entry of air into said bag-like enclosure.

4. The golf practice aid of claim 3 wherein said valve includes a release for manually opening said valve to admit air into said bag.

5. The golf practice aid of claim 1 wherein said bag-like enclosure is made from vinyl.

6. The golf practice aid of claim 1 wherein said granular media fills at least 75% of the volume of said bag.

7. A method for configuring a golf practice mat to simulate sloped or irregular terrain comprising:

(a) securing the practice mat to a pliable bag;

(b) substantially filling the pliable bag with a granular media;

(c) shaping the bag in the desired configuration by manually pressing the outer surface of the bag to shift the granular media contained in the bag; and (d) extracting air from the bag to cause the bag to conform to the shape of the granular media and to provide a relatively rigid support for the flexible mat.

* * * * *